US010814199B1

(12) United States Patent
Wu et al.

(10) Patent No.: US 10,814,199 B1
(45) Date of Patent: Oct. 27, 2020

(54) BASKETBALL SHOOTING TRAINING DEVICE

(71) Applicants: Kun-Cheng Wu, Changhua (TW); Fan Chia, Taichung (TW)

(72) Inventors: Kun-Cheng Wu, Changhua (TW); Fan Chia, Taichung (TW)

( * ) Notice: Subject to any disclaimer, the term of this patent is extended or adjusted under 35 U.S.C. 154(b) by 0 days.

(21) Appl. No.: 16/546,443

(22) Filed: Aug. 21, 2019

(51) Int. Cl.

| | |
|---|---|
| ***A63B 69/00*** | (2006.01) |
| ***A63B 63/08*** | (2006.01) |
| ***A63B 71/06*** | (2006.01) |
| *A63B 63/00* | (2006.01) |

(52) U.S. Cl.
CPC ..... *A63B 69/0071* (2013.01); *A63B 63/083* (2013.01); *A63B 71/0669* (2013.01); *A63B 2063/001* (2013.01); *A63B 2225/093* (2013.01)

(58) Field of Classification Search
CPC ..... A63B 69/0071; A63B 63/083; A63B 2063/001; A63B 71/0669; A63B 2225/093; A63F 7/20; A63F 7/0612; F41J 5/00
See application file for complete search history.

(56) References Cited

U.S. PATENT DOCUMENTS 4,697,810 A * 10/1987 Mathison ..... A63B 63/083 473/433
5,160,138 A * 11/1992 Sanders ..... A63B 69/0026 473/438
5,310,176 A * 5/1994 Berg ..... A63B 63/083 473/433
5,312,099 A * 5/1994 Oliver, Sr. ..... A63B 63/083 473/433
5,364,091 A * 11/1994 Sebek ..... A63B 69/0071 473/433
5,540,428 A * 7/1996 Joseph ..... A63B 63/083 473/433
6,536,770 B1 * 3/2003 Yang ..... A63B 63/06 273/317.3
8,616,553 B1 * 12/2013 Tsai ..... A63B 61/02 273/317.3
9,289,663 B1 * 3/2016 Bollinger ..... A63B 63/083
10,080,944 B1 * 9/2018 Bowling ..... A63B 63/083
2001/0055999 A1 * 12/2001 Bush ..... A63B 69/0071 473/433
2005/0085320 A1 * 4/2005 Joseph ..... A63B 69/34 473/433

(Continued)

*Primary Examiner* — Raleigh W Chiu
(74) *Attorney, Agent, or Firm* — Karin L. Williams; Mayer & Williams

(57) ABSTRACT

A basketball shooting training includes a stand, a rotatable hoop module, a blocking module, and a guide module. The stand includes a horizontal segment and a vertical segment. The rotatable hoop module includes a frame and a backboard. The blocking module includes two columns, a collection member, an obstruction unit, and two fixed pulley sets. The guide module includes a conducting device mounted on the horizontal segment of the stand, and the supply portion extends outward from the stand. The mounting of the stand is fixed on a bottom of the conducting device, and the rotatable hoop module further includes a support post on which the backboard is disposed. A movable seat is connected on a bottom of the support post, the movable seat is disposed on and rotates along the mounting, and the conducting device has an arcuate track on which the support post slides.

5 Claims, 11 Drawing Sheets

(56) References Cited

U.S. PATENT DOCUMENTS

| | | | | |
|---|---|---|---|---|
| 2006/0154751 | A1* | 7/2006 | Huntsberger | A63B 24/0021 473/433 |
| 2008/0042358 | A1* | 2/2008 | Chen | G07F 17/38 273/317.3 |
| 2008/0252018 | A1* | 10/2008 | Chung | A63B 24/0021 273/402 |
| 2009/0137347 | A1* | 5/2009 | Jenkins | A63B 69/0071 473/433 |
| 2010/0210379 | A1* | 8/2010 | Shelley | A63B 69/0071 473/433 |
| 2010/0261557 | A1* | 10/2010 | Joseph | G09B 19/0038 473/433 |
| 2010/0285906 | A1* | 11/2010 | Wares | A63B 69/0071 473/433 |
| 2012/0142458 | A1* | 6/2012 | He | A63B 63/083 473/480 |
| 2013/0005512 | A1* | 1/2013 | Joseph | A63B 69/0071 473/431 |
| 2015/0051023 | A1* | 2/2015 | Aipperspach | A63B 69/0071 473/433 |
| 2015/0051026 | A1* | 2/2015 | Halliburton | A63B 63/083 473/480 |
| 2016/0287964 | A1* | 10/2016 | Jones | A63B 63/083 |
| 2018/0147468 | A1* | 5/2018 | Gordon | A63B 24/0062 |
| 2020/0086193 | A1* | 3/2020 | Lu | A63B 63/083 |

* cited by examiner portion A of FIG. 1 portion B of FIG. 1

BASKETBALL SHOOTING TRAINING DEVICE

FIELD OF THE INVENTION

The present invention relates to a basketball shooting training device which trains players to enhance a field goal percentage after shooting basketballs.

BACKGROUND OF THE INVENTION

Basketball is a competitive sport game that shooting the basketballs into the basket after dribbling and passing the basketballs. At present, basketball is the most popular game in the world, and three-point shot is exciting in the basketball game.

To correct shooting posture and position, a sensing device and internet of things are applicable for the basketball game.

A training device is disclosed in TW Patent No. 1523672 by the inventor of the present invention so as to adjust elevation angle of shooting basketballs to be more than 45 degrees, thus enhancing the field goal percentage. However, the training device cannot be adjusted at any desired angles in different directions.

The present invention has arisen to mitigate and/or obviate the afore-described disadvantages.

SUMMARY OF THE INVENTION

The primary aspect of the present invention is to provide a basketball shooting training device which trains players to shoot basketballs more than 45 degrees so as to enhance a field goal percentage after shooting the basketballs.

Another aspect of the present invention is to provide a basketball shooting training device which simulates different shooting positions in various directions relative to the rotatable hoop module so as to train the player to shoot the basketballs at the different shooting positions.

To obtain the above aspects, a basketball shooting training device provided the present invention contains: a stand, a rotatable hoop module, a blocking module, and a guide module.

The stand includes a horizontal segment and a vertical segment.

The rotatable hoop module is fixed on the stand, and the rotatable hoop module includes a frame and a backboard, wherein the frame is parallel to the horizontal segment, the backboard is parallel to the vertical segment, and the frame is disposed on the backboard.

The blocking module is mounted on the stand opposite to the backboard, and the blocking module includes two columns, a collection member, an obstruction unit, and two fixed pulley sets.

The collection member is defined between the two columns so as to stop basketballs rebounding, the obstruction unit is a rope, and the two fixed pulley sets are disposed on two tops of the two columns respectively, wherein two ends of the obstruction unit are inserted across the two fixed pulley sets to connect with two adjustment portions individually so as to pull the two adjustment portions to adjust a height of the obstruction unit.

The guide module includes a conducting device mounted on the horizontal segment of the stand, and the supply portion extends outward from the stand.

The mounting of the stand is fixed on a bottom of the conducting device, the rotatable hoop module further includes a support post on which the backboard is disposed, a movable seat is connected on a bottom of the support post, wherein the movable seat is disposed on and rotates along the mounting, and the conducting device has an arcuate track on which the support post slides.

Thereby, the support post of the rotatable hoop module is adjustable based on using requirements so as to adjust the rotatable hoop module to any angles and to adjust the height of the obstruction unit of the blocking module. After the players shoot the basketballs to the frame of the rotatable hoop module, the basketballs pass above the obstruction unit, thus shooting the basketballs over 45 degrees and simulating the different shooting positions in various directions relative to the rotatable hoop module.

Preferably, the frame has a first photoelectric switch, and the supply portion has a second photoelectric switch. The first photoelectric switch and the second photoelectric switch are electrically connected with a processing module, and the processing module is configured to calculate and display a shooting score to the players.

Preferably, the supply portion has a shield and a stopping portion.

DETAILED DESCRIPTION OF THE PREFERRED EMBODIMENTS

Figure 1:
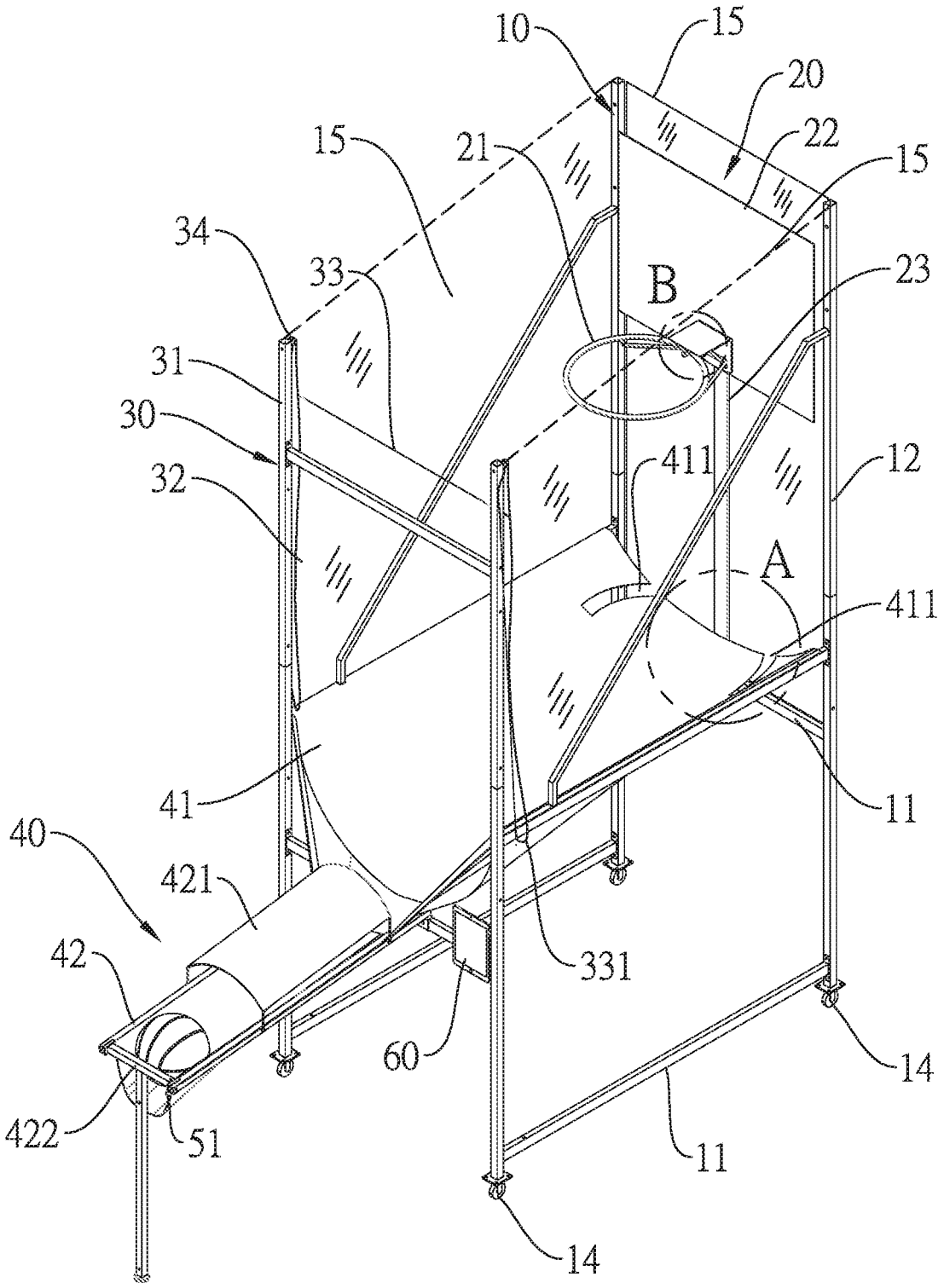
FIG. 1 is a perspective view showing the assembly of a basketball shooting training device according to a preferred embodiment of the present invention.
Figure 2:
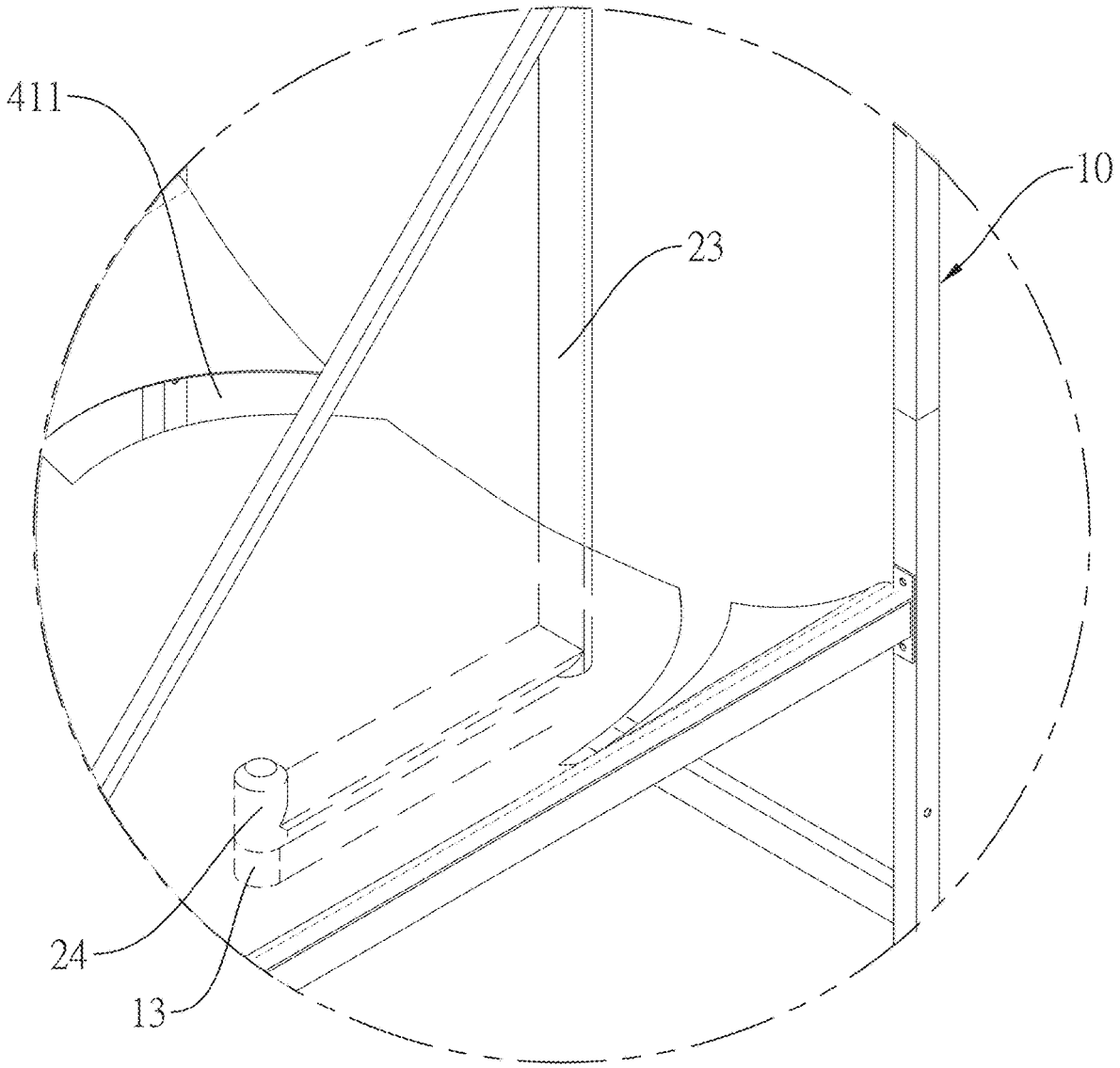
FIG. 2 is an amplified perspective view of a portion A of FIG. 1.
Figure 3:
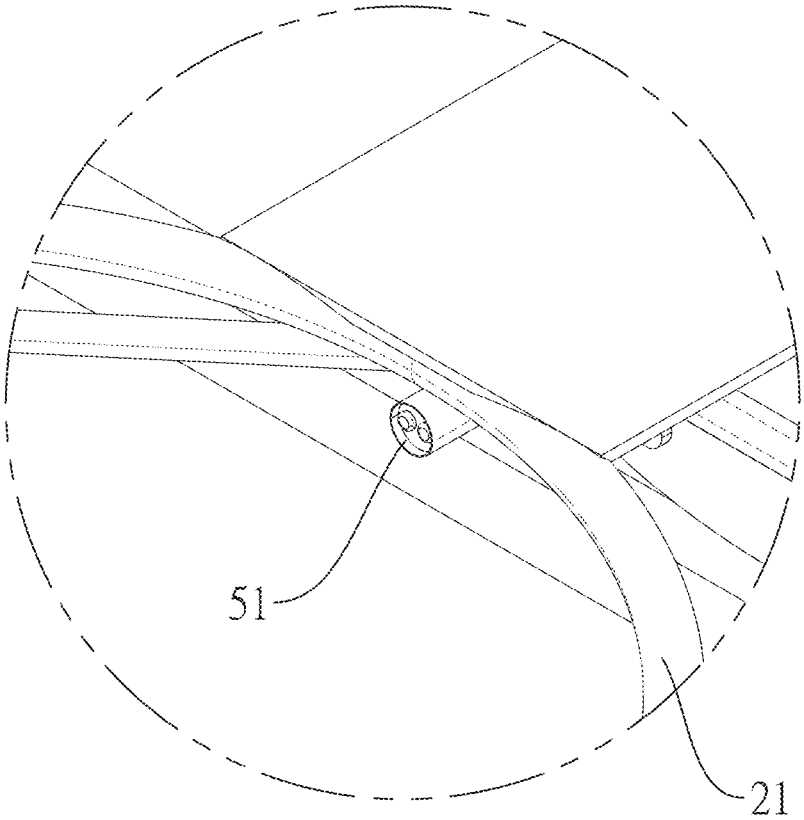
FIG. 3 is an amplified perspective view of a portion B of FIG. 1.
Figure 4:
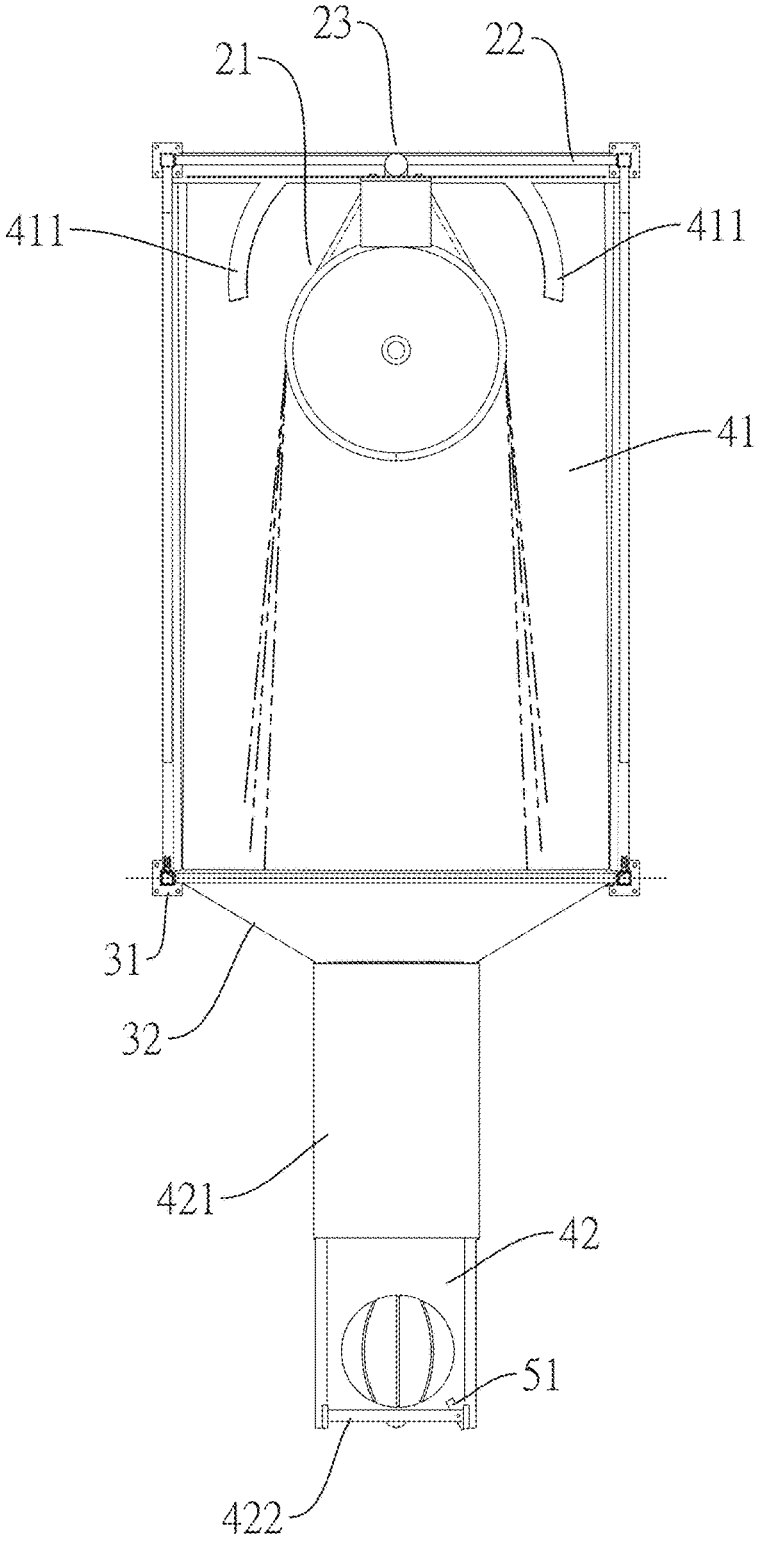
FIG. 4 is a top plan view showing the assembly of the basketball shooting training device according to the preferred embodiment of the present invention.
Figure 5:
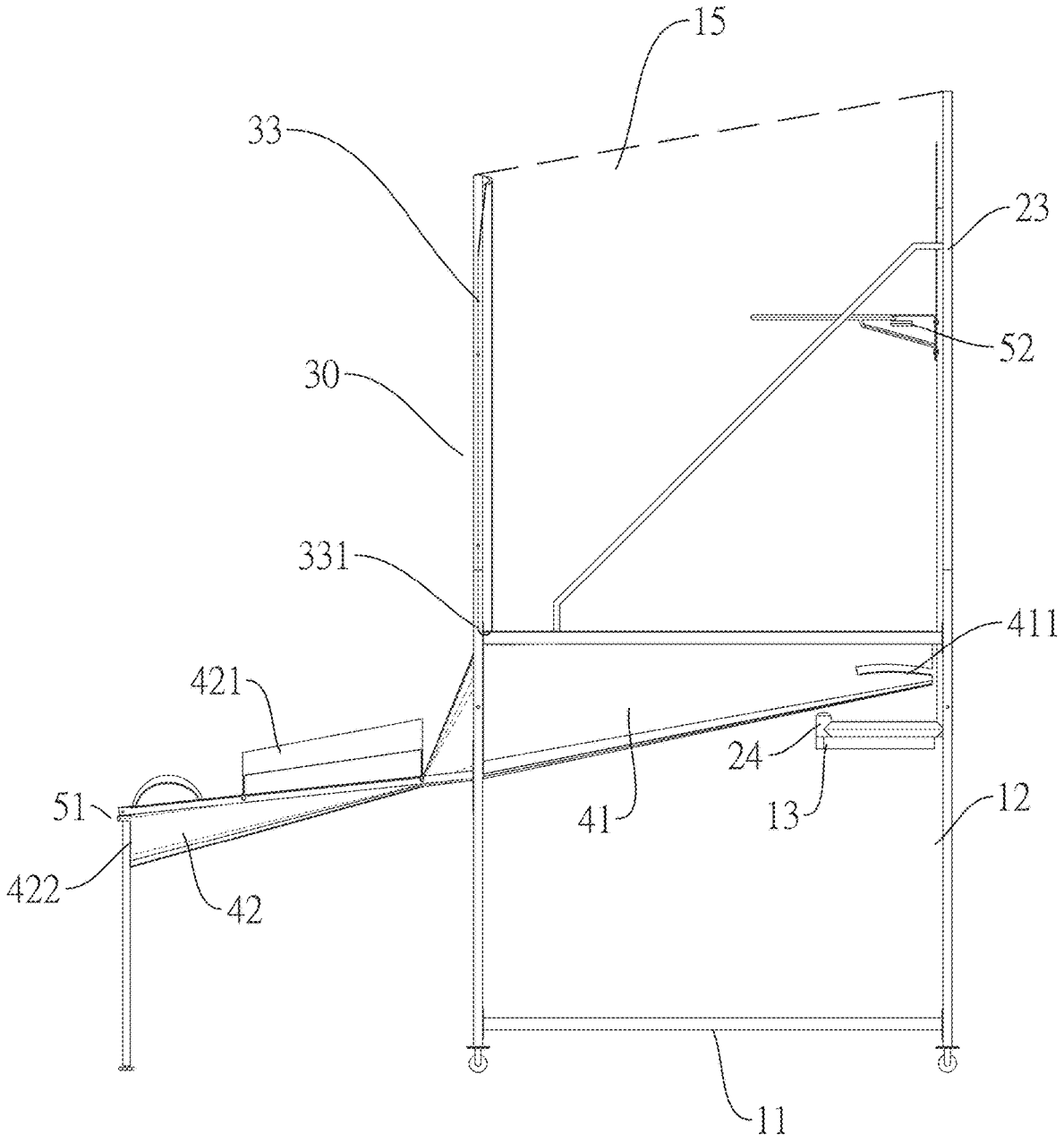
FIG. 5 is a side plan view showing the assembly of the basketball shooting training device according to the preferred embodiment of the present invention.

With reference to FIGS. 1-9, a basketball shooting training device comprises: a stand 10, a rotatable hoop module 20, a blocking module 30, and a guide module 40.

Referring to FIGS. 1, 4, 5, 6 and 8-10, the stand 10 is formed in an L shape, the stand 10 includes a horizontal segment 11, a vertical segment 12, multiple rollers 14 mounted on a bottom of the stand 10 and configured to move the stand 10, a mounting 13, and multiple stop sheets 15 configured to stop basketballs, wherein after the basketballs are stopped by the multiple stop sheets 15, they are moved back to an original position (i.e., a supply portion 42) by using a guide module 40.

As shown in FIGS. 1, 3, 6 and 8-10, the rotatable hoop module 20 is fixed on the stand 10, and the rotatable hoop module 20 includes a frame 21, a backboard 22, and a support post 23, wherein the frame 21 is parallel to the horizontal segment 11, the backboard 22 is parallel to the vertical segment 12 and is fixed on the support post 23, the frame 21 is disposed on the backboard 22, and the backboard 22, and a movable seat 24 is connected on a bottom of the support post 23. The frame 21 has a first photoelectric switch 51 which is any one of a grating sensor, an infrared sensor, and a dynamic sensor.

Figure 6:
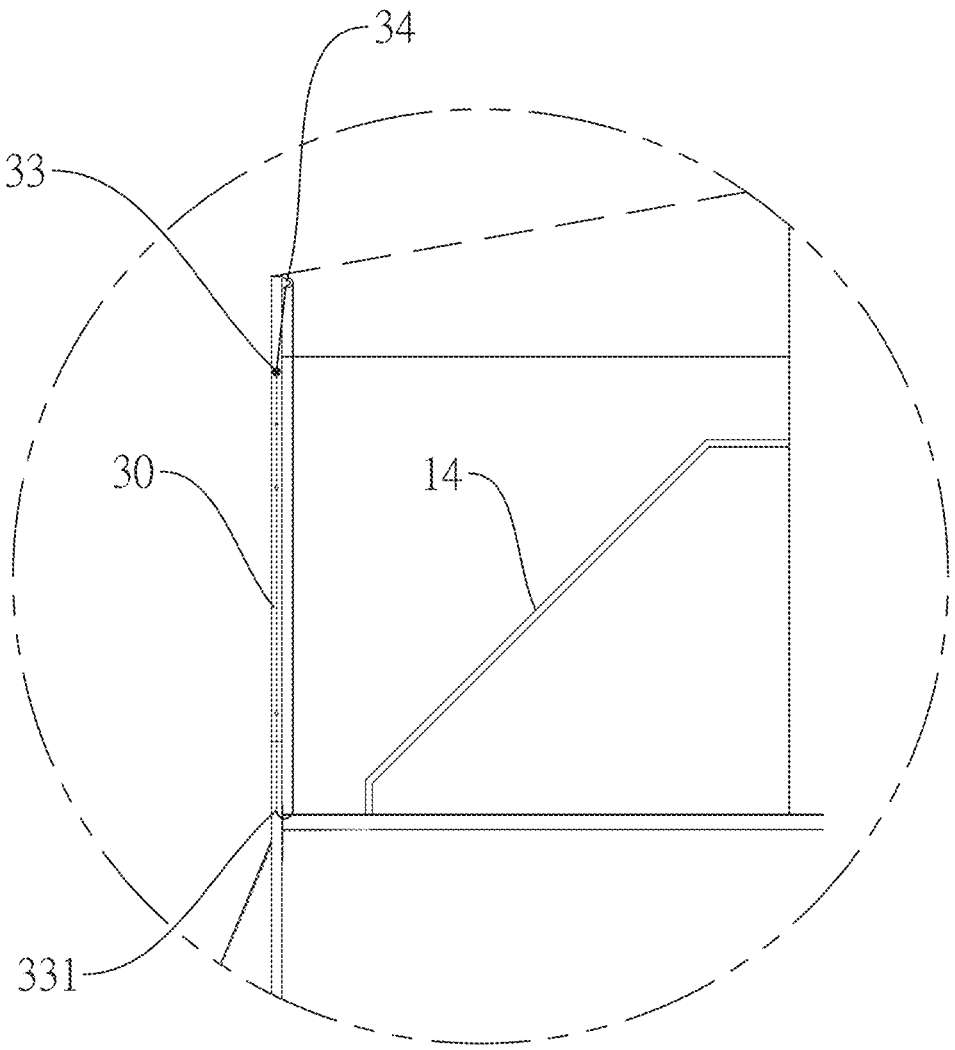
FIG. 6 is a side plan view showing the assembly of a blocking module of the basketball shooting training device according to the preferred embodiment of the present invention.
Figure 7:
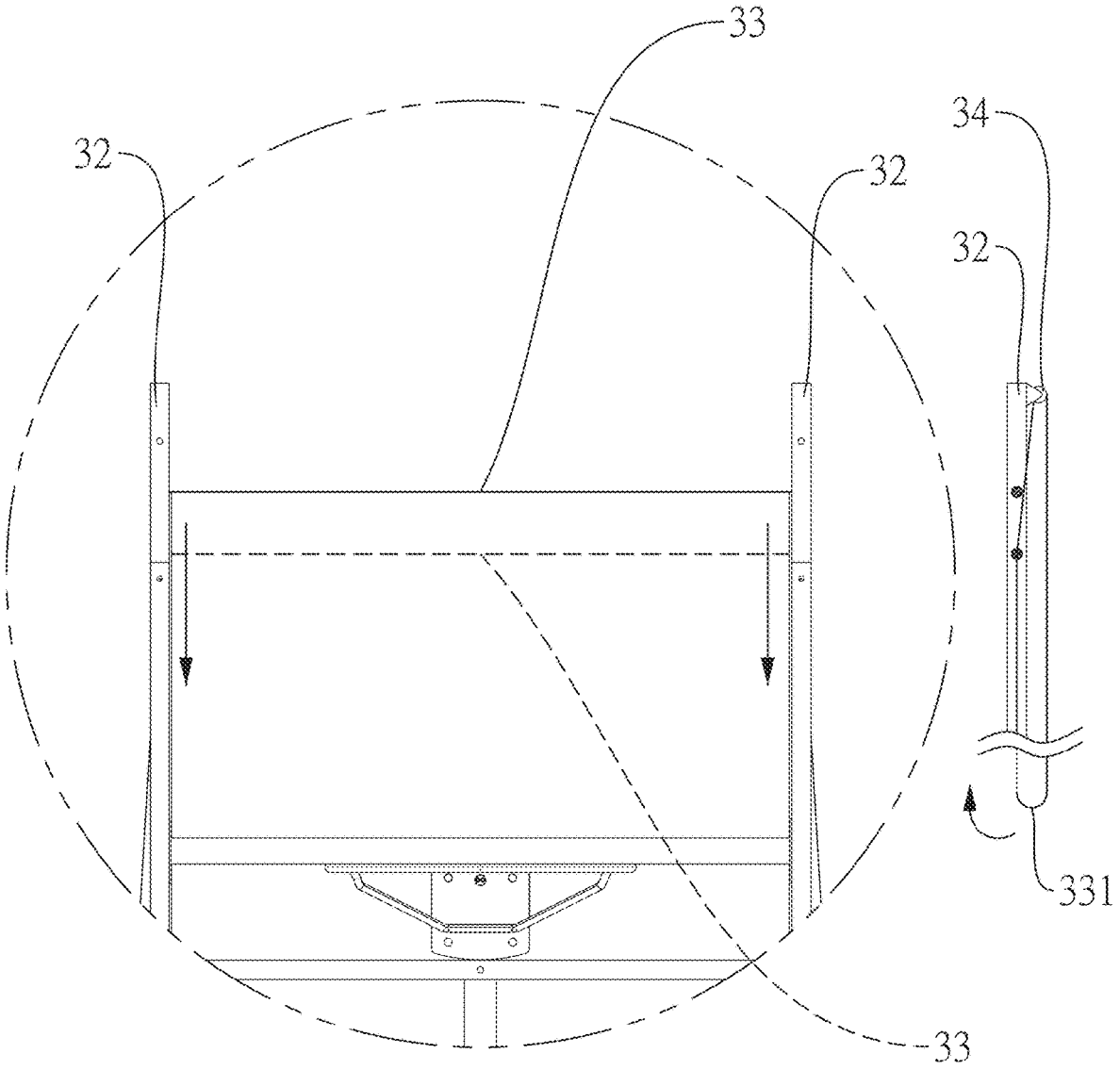
FIG. 7 is a side plan view showing the operation of the blocking module of the basketball shooting training device according to the preferred embodiment of the present invention.

As shown in FIGS. 1 and 4-10, the blocking module 30 is mounted on the stand 10 opposite to the backboard 22, and the blocking module 30 includes two columns 31, a collection member 32, an obstruction unit 33, and two fixed pulley sets 34. The collection member 32 is defined between the two columns 31 so as to stop the basketballs rebounding, and the collection member 32 includes a semicircular orifice (not shown) formed on a bottom thereof so that the basketballs move into the supply portion 42 via the semicircular orifice, thus avoiding the basketballs dropping beside two sides of the semicircular orifice. The obstruction unit 33 is a rope, and the two fixed pulley sets 34 are disposed on two tops of the two columns 31 respectively, as shown in FIGS. 6 and 7, wherein two ends of the obstruction unit 33 are inserted across the two fixed pulley sets 34 to connect with two adjustment portions 331 individually so as to pull the two adjustment portions 331 to adjust a height of the obstruction unit 33.

As illustrated in FIGS. 1, 4, 5, 6 and 8-10, the guide module 40 includes a conducting device 41 mounted on the horizontal segment 11 of the stand 10, and the supply portion 42 extends outward from the stand 10, wherein the supply portion 42 has a shield 421, a stopping portion 422, and a second photoelectric switch 52. After shooting the basketballs, the conducting device 41 guides the basketballs to move back to the supply portion 42 for supplying the basketballs to players again.

With reference to FIGS. 1-11, the first photoelectric switch 51 and the second photoelectric switch 52 are configured to sense a field goal percentage of shooting the basketballs, wherein a field goal percentage=field goal number/shooting number.

Figure 11:
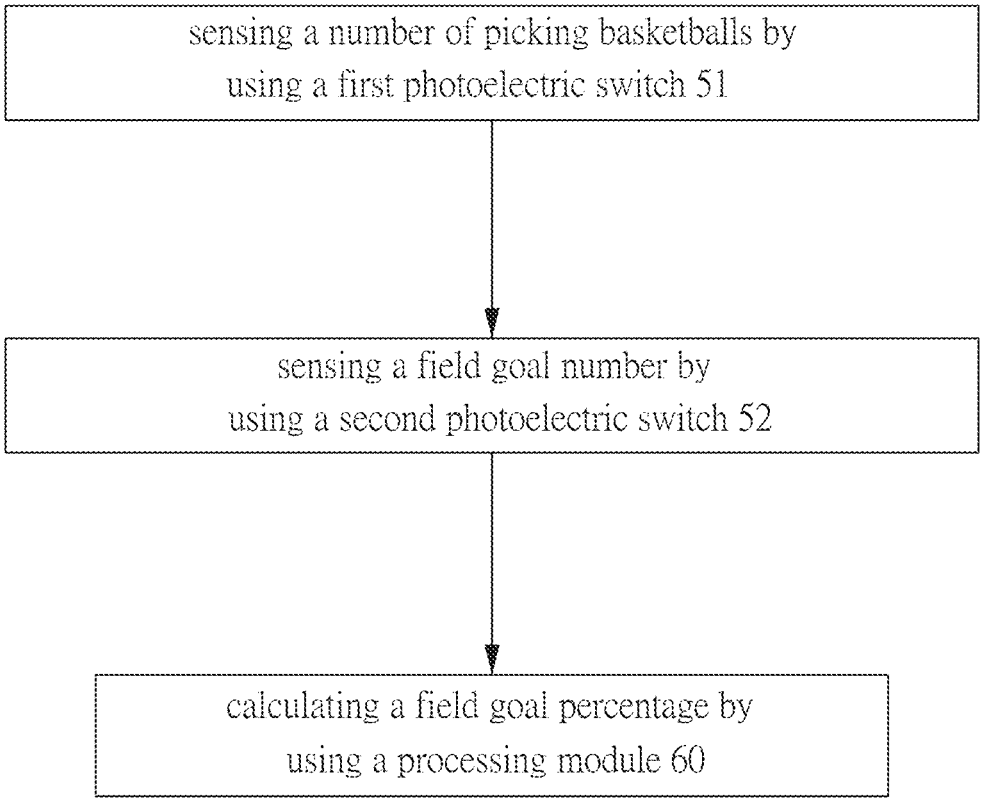
FIG. 11 is a flow chart of calculating a field goal percentage of shooting basketballs according to the preferred embodiment of the present invention.

Referring to FIG. 11, the first photoelectric switch 51 and the second photoelectric switch 52 is electrically connected with a processing module 60 which is configured to calculate and display a shooting score to the players, thus providing references data of shooting posture. The processing module 60 is fixed on a front end of the blocking module 30. When a shooting elevation angle is not enough, the basketballs hit the collection member 32 to produce an insufficient elevation angle recorded in the processing module 60, thus correcting the shooting posture of the players and enhancing the field goal percentage.

Figure 8:
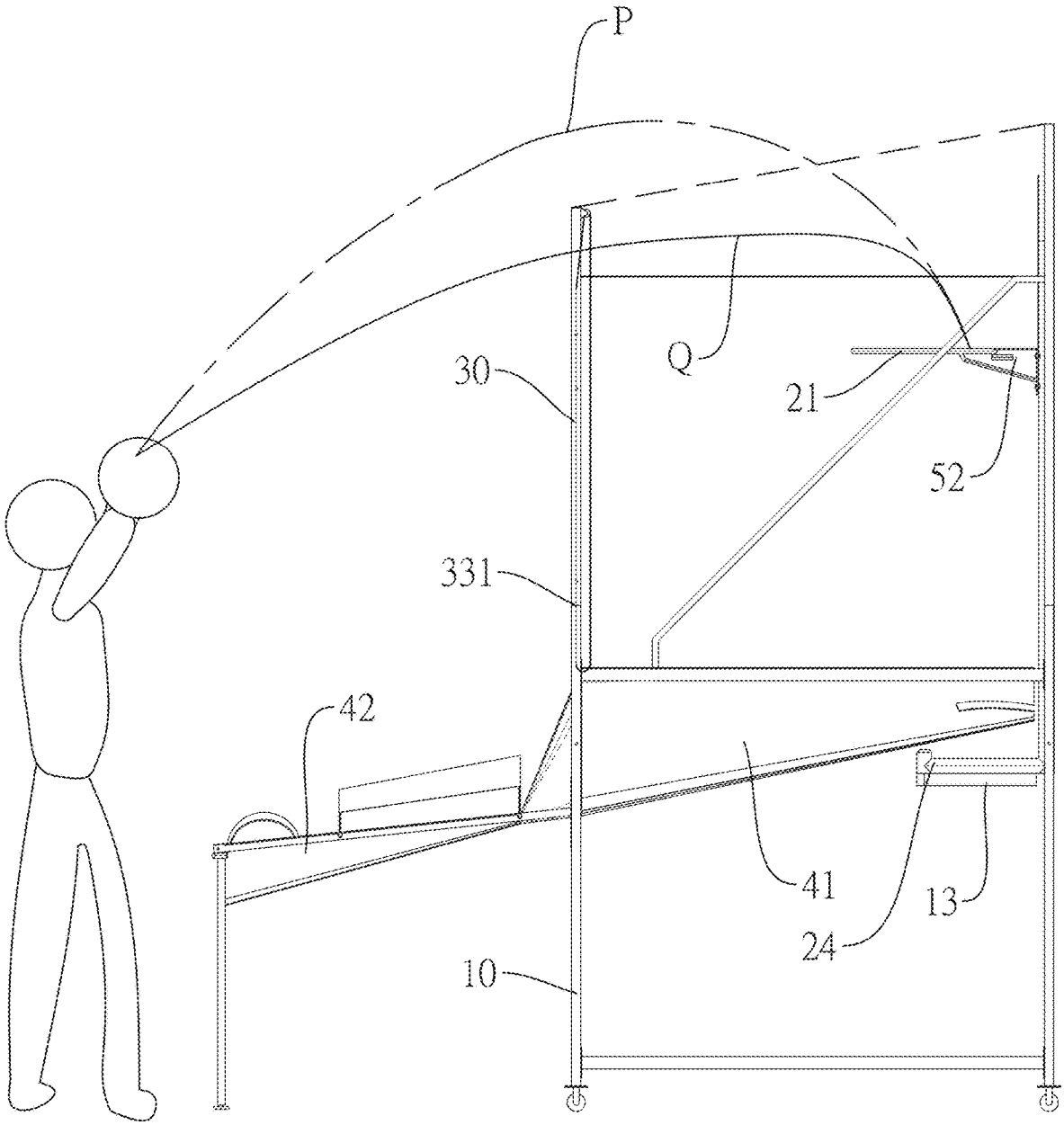
FIG. 8 is a side plan view showing the operation of the basketball shooting training device according to the preferred embodiment of the present invention.
Figure 9:
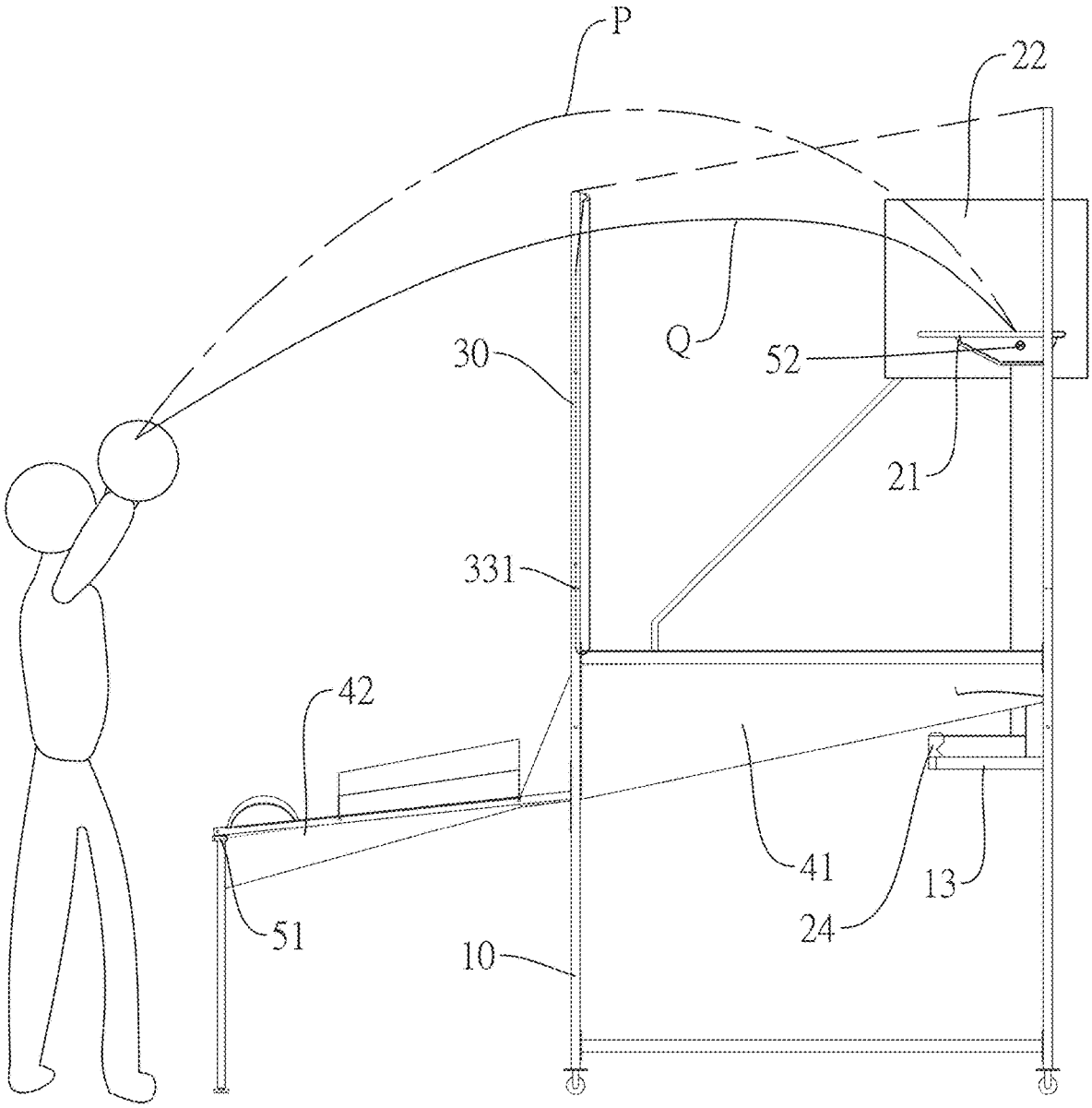
FIG. 9 is another side plan view showing the operation of the basketball shooting training device according to the preferred embodiment of the present invention.
Figure 10:
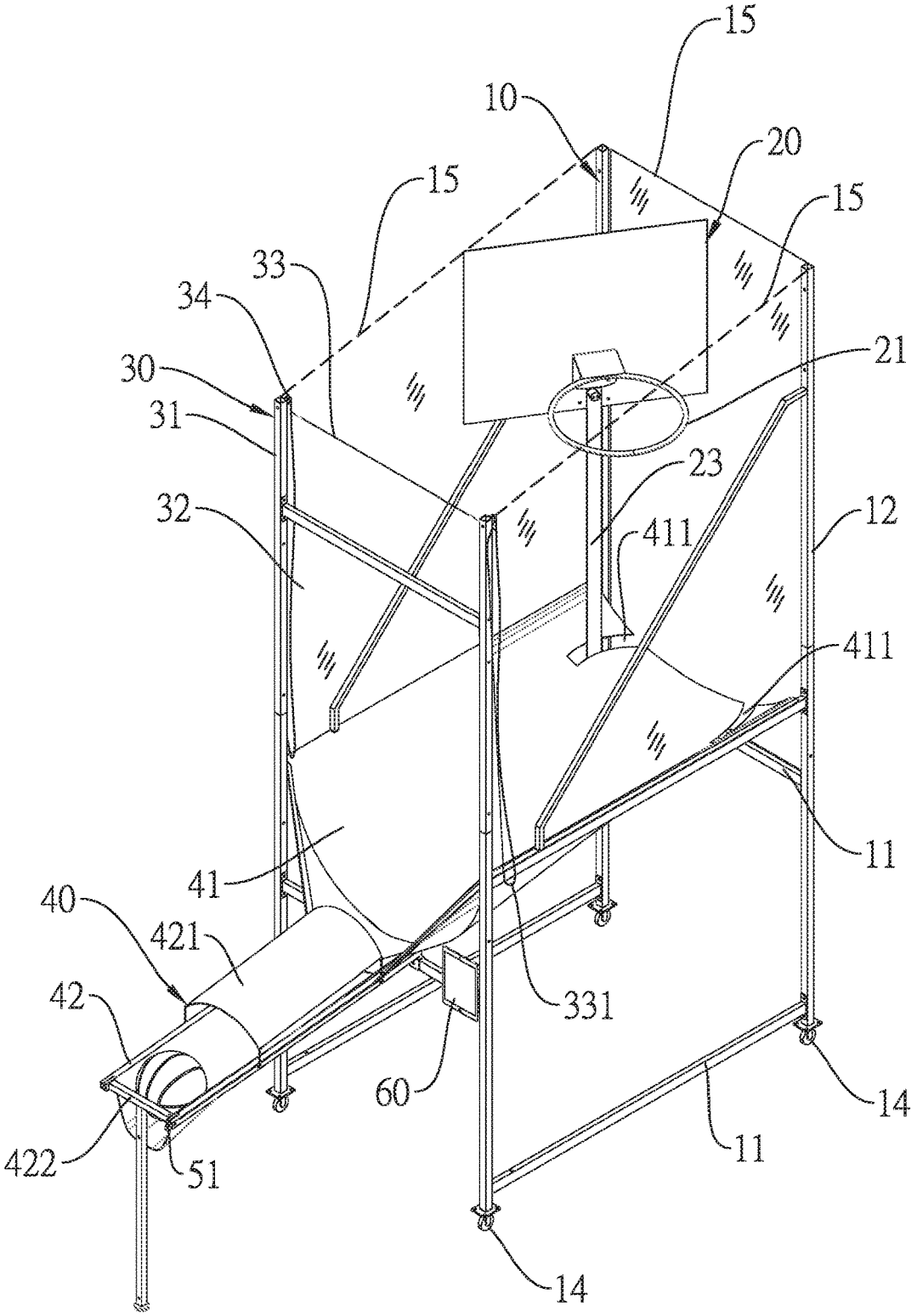
FIG. 10 is a perspective view showing the operation of the basketball shooting training device according to the preferred embodiment of the present invention.

As shown in FIGS. 8-10, the rotatable hoop module 20 is configured to simulate shooting effects of different shooting positions respectively. The mounting 13 is fixed on a bottom of the conducting device 41, the movable seat 24 is disposed on and rotates along the mounting 13 so as to drive the support post 23, the backboard 22, and the frame 21 to rotate, wherein the conducting device 41 has an arcuate track 411 on which the support post 23 slides.

Thereby, the support post 23 of the rotatable hoop module 20 is adjustable based on using requirements so as to adjust the rotatable hoop module 20 to any angles and to adjust the height of the obstruction unit 33 of the blocking module 30. After the players shoot the basketballs to the frame 21 of the rotatable hoop module 20, the basketballs pass above the obstruction unit 33, thus shooting the basketballs over 45 degrees and simulating the different shooting positions in various directions relative to the rotatable hoop module 20.

An ideal shooting path is an ideal parabola P from the supply portion 42 to the frame 21 via the blocking module 30. When the shooting elevation angle of shooting the basketballs is less than 45 degrees, the basketballs drop to a space below the obstruction unit 33 inside the stand 10 so as to avoid the basketballs rebounding. When the shooting elevation angle is more than 45 degrees, a basketball motion track Q is close to the ideal parabola P. After correcting the shooting posture and the shooting elevation angle, the field goal percentage is increased, thus shooting the basketballs into the frame 21.

Preferably, the basketball shooting training facilitates shooting the basketballs ahead of and beside the basketball shooting training. The frame 21 and the mounting 13 are concentric.

The first photoelectric switch 51 and the second photoelectric switch 52 are configured to sense the field goal percentage and the shooting score. The processing module 60 produces and analyzes the reference date to train the players. Preferably, the shooting elevation angle is corrected by ways of a machine vision system (not shown) so as to enhance the field goal percentage.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention

What is claimed is:

1. A basketball shooting training comprising: a stand, a rotatable hoop module, a blocking module, and a guide module;

wherein the stand includes a horizontal segment and a vertical segment;

wherein the rotatable hoop module is fixed on the stand, and the rotatable hoop module includes a frame and a backboard, wherein the frame is parallel to the horizontal segment, the backboard is parallel to the vertical segment, and the frame is disposed on the backboard;

wherein the blocking module is mounted on the stand opposite to the backboard, and the blocking module includes two columns, a collection member, an obstruction unit, and two fixed pulley sets;

wherein the collection member is defined between the two columns so as to stop basketballs rebounding, the obstruction unit is a rope, and the two fixed pulley sets are disposed on two tops of the two columns respectively, wherein two ends of the obstruction unit are inserted across the two fixed pulley sets to connect with two adjustment portions individually so as to pull the two adjustment portions to adjust a height of the obstruction unit;

wherein the guide module includes a conducting device mounted on the horizontal segment of the stand, and a supply portion extends outward from the stand;

wherein a mounting of the stand is fixed on a bottom of the conducting device, the rotatable hoop module further includes a support post on which the backboard is disposed, a movable seat is connected on a bottom of the support post, wherein the movable seat is disposed on and rotates along the mounting, and the conducting device has an arcuate track on which the support post slides.

2. The basketball shooting training as claimed in claim 1, wherein the frame has a first photoelectric switch, and the supply portion has a second photoelectric switch, wherein the first photoelectric switch and the second photoelectric switch are electrically connected with a processing module, and the processing module is disposed ahead of the blocking module.

3. The basketball shooting training as claimed in claim 1, wherein the supply portion has a shield and a stopping portion.

4. The basketball shooting training as claimed in claim 1, wherein the conducting device guides the basketballs to move back to the supply portion.

5. The basketball shooting training as claimed in claim 1, wherein the frame and the mounting are concentric.

* * * * *